United States Patent [19]

Wahle

[11] Patent Number: 4,605,014

[45] Date of Patent: Aug. 12, 1986

[54] MACHINE FOR THE PRODUCTION OF SMOKERS' PRODUCTS WITH CAVITIES BETWEEN THEIR ROD-SHAPED COMPONENTS

[75] Inventor: Günter Wahle, Reinbek, Fed. Rep. of Germany

[73] Assignee: Hauni-Werke Körber & Co. KG, Hamburg, Fed. Rep. of Germany

[21] Appl. No.: 537,584

[22] Filed: Sep. 30, 1983

[30] Foreign Application Priority Data

Oct. 27, 1982 [DE] Fed. Rep. of Germany ..... 3239763

[51] Int. Cl.[4] ..... A24C 5/52

[52] U.S. Cl. ..... 131/94; 131/282

[58] Field of Search ..... 131/44, 94, 95, 280, 131/282

[56] References Cited

U.S. PATENT DOCUMENTS 2,942,606 6/1960 Rowlands ..... 131/94

*Primary Examiner*—V. Millin

*Attorney, Agent, or Firm*—Peter K. Kontler

[57] ABSTRACT

A fluted drum transports filter plugs and pairs of plain cigarettes in successive flutes past two rollers which cause the cigarettes to move inwardly toward the respective plug. In order to ensure the establishment of a cavity between each cigarette and the respective end of the corresponding plug, each flute contains two distancing elements whose width matches the acceptable width of the cavities. The outermost portions of the distancing elements taper in a direction away from the bottom portions of the respective flutes to allow for convenient introduction of filter plugs and cigarettes which are held by suction during transport past the rollers and on to the station where the groups of coaxial and properly spaced-apart filter plugs and cigarettes are removed from their flutes.

11 Claims, 2 Drawing Figures

MACHINE FOR THE PRODUCTION OF SMOKERS' PRODUCTS WITH CAVITIES BETWEEN THEIR ROD-SHAPED COMPONENTS

BACKGROUND OF THE INVENTION

The present invention relates to improvements in machines for the production of rod-shaped smokers' products, and more particularly to improvements in machines for the production of filter cigarettes or other types of rod-shaped articles which contain tobacco and which are provided with a recess adjacent to, or with at least one cavity between, their rod-shaped components, e.g., with a cavity between the tobacco-containing and filter-containing portions. The cavities can be disposed between pairs of identical or different rod-shaped components of smokers' products, e.g., between the filter plug and the plain cigarette of a filter cigarette of unit length or between two identical or different filter plugs in the composite mouthpiece for a filter cigarette, cigar or cigarillo.

It is well known to provide cigarettes with recessed filters, with cavities between discrete rod-shaped components of filters or with cavities between the filter plugs and the tobacco-containing portions. Reference may be had, for example, to commonly owned U.S. Pat. Nos. 3,010,457 (Schubert), 3,368,460 (Schubert) and 3,817,158 (Wahle). It is also known to provide the wrapping material around the cavities with holes in the form of perforations which serve to admit metered quantities of cool atmospheric air into the cavities so that the air mixes with and dilutes and cools the column of tobacco smoke flowing into the smoker's mouth. This is believed to result in deposition of a high percentage of condensable ingredients of tobacco smoke in the cavity proper, i.e., before the smoke reaches the mouth, so that the filter merely performs a secondary or auxiliary cleaning function. Many makers of cigarettes believe that such mode of influencing tobacco smoke on its way from the tobacco-containing portion of a cigarette into the mouth of the smoker is likely to guarantee a more predictable and more uniform filtering action, not only immediately after the cigarette is lighted but also during combustion of the major part of or the entire tobacco-containing portion.

The manufacture of smokers' products with recesses behind the rearmost rod-shaped components or with cavities between neighboring rod-shaped components presents many problems, especially if such products are to be manufactured in modern high-speed machines which are designed to turn out in excess of 7000 articles per minute. The main problem is that presently known machines for the mass production of filter cigarettes, papyrossi and analogous recessed or chambered smokers' products are incapable of ensuring that the width of recesses or cavities in each of a large number of articles will be the same. If the depth of a recess or the width of a cavity is less than desired, the quantity of air which can be admitted into tobacco smoke is insufficient to ensure adequate circulation and agitation of smoke, intermixing with atmospheric air and/or deposition of condensate in the recess or cavity. If the cavity is too wide or the recess is too deep, the length of the tobacco-containing portion is less than prescribed or the composite filter of such an article lacks one of its components.

OBJECTS AND SUMMARY OF THE INVENTION

An object of the invention is to provide a novel and improved machine which can ensure the establishment and maintenance of recesses or cavities of requisite depth or width irrespective of the speed at which the recessed or chambered rod-shaped smokers' products are produced.

Another object of the invention is to provide the machine with a novel and improved conveyor for the transport of rod-shaped components of filter cigarettes or the like.

A further object of the invention is to provide a novel combination of parts which can be used in existing machines for the production of filter cigarettes, papyrossi and analogous rod-shaped smokers' products to ensure the establishment of recesses or cavities which are not too shallow or to narrow irrespective of the speed at which such products are transported during their assembly and/or other processing in a filter tipping or filter plug making machine.

An additional object of the invention is to provide a filter tipping, filter rod making or an analogous machine with very simple, compact and inexpensive means for ensuring that the depth of recesses and/or the width of cavities cannot be reduced below the minimum acceptable value and, if necessary, for ensuring that such depth or width will not exceed a maximum acceptable value.

Another object of the invention is to provide a machine which can perform the aforedescribed functions in a small area, without additional expenditures of energy, and in the space which is invariably available in the machine.

The invention resides in the provision of a machine, e.g., a filter tipping machine, for manipulating rod-shaped articles of the tobacco processing industry, particularly for turning out filter cigarettes, with cavities or chambers between their rod-shaped constituents. For example, each filter cigarette can be provided with a cavity between its tobacco-containing component and its filter component and/or with a cavity between two discrete filter components. The machine comprises a conveyor having elongated article-receiving flutes and at least one distancing element in each flute. Each distancing element has a predetermined thickness, as considered in the longitudinal direction of the respective flute. The machine further comprises one or more drum-shaped conveyors or other suitable means for feeding rod-shaped articles into the flutes at the opposite sides of the respective distancing elements so that the articles at the opposite sides of the distancing elements are separated from one another by gaps having a width at least matching the thickness of the respective distancing elements. Thus, if the predetermined width of the distancing elements matches the width of the aforementioned cavities, the width of the cavity in a smokers' product or in a rod-shaped portion of a smokers' product which is obtained from the rod-shaped articles in a flute must at least equal the minimum acceptable value. The fluted conveyor preferably includes or constitutes a rotary drum with a peripheral surface which is provided with axially parallel flutes. Each distancing element has a pair of surfaces which face away from each other toward the respective ends of the corresponding flute and constitute abutments for the articles at the opposite sides of such distancing elements. At least a portion of each distancing element tapers in a direction away from the bottom portion of the respective flute to facilitate insertion of rod-shaped articles at the opposite sides of such distancing elements.

Each flute can accommodate several distancing elements, preferably two spaced-apart distancing elements which divide the respective flute into a relatively short centrally located section for a filter plug of double unit length and two relatively long outer sections each of which can receive the major part of a plain cigarette of unit length. The distancing elements can but need not be integral with the fluted conveyor.

The fluted conveyor is arranged to advance its flutes along a predetermined (preferably endless) path extending at right angles to the longitudinal directions of the flutes, and the machine preferably further comprises means for biasing at least one article in each flute toward the respective distancing element during advancement of flutes along a predetermined portion of their path. This ensures or renders it more likely that the width of the gap between two neighboring articles in a flute matches a predetermined value, namely, the optimum width of the cavity between two components of a filter cigarette or the like. In order to enable the biasing means to reach the articles in the flutes, the length of at least one section of each flute is selected in such a way that a portion of the article therein extends beyond the flute so that the biasing means can act upon that portion of the article in each flute which extends beyond the flute and can be readily engaged by a roller or an analogous part of the biasing means.

The fluted conveyor can be provided with suction ports or other suitable means for attracting the articles to the conveyor, at least while the articles advance along the aforementioned portion of the path for the flutes.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
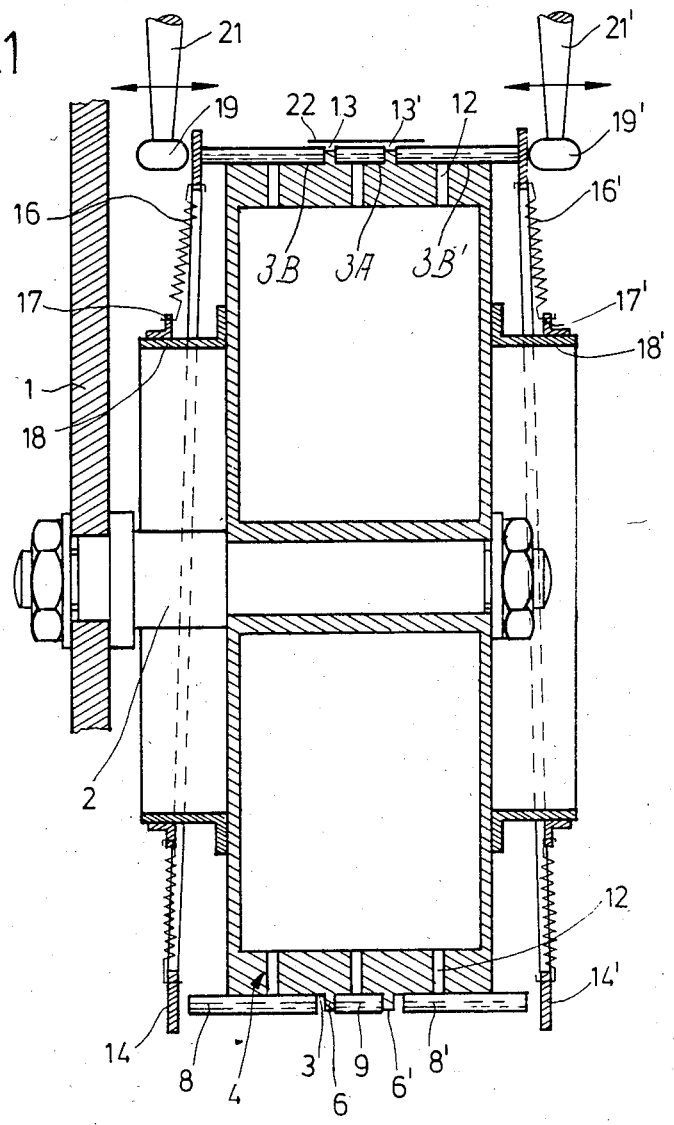
FIG. 1 is a fragmentary sectional view of a machine which embodies one form of the invention and wherein each flute of the fluted conveyor contains two spaced-apart distancing elements.

Referring first to FIG. 1, there is shown a portion of a filter tipping machine, e.g., a machine of the type known as MAX S which is manufactured and sold by the assignee of the present application and is described, for example, in commonly owned U.S. Pat. No. 4,277,678 to Wahle et al. The disclosure of this patent is incorporated herein by reference. The machine comprises a frame or housing 1 supporting a horizontal shaft 2 for a rotary drum-shaped conveyor 4 whose peripheral surface is formed with elongated, straight, axially parallel article-receiving flutes 3 extending all the way between the two end faces of the conveyor 4. The conveyor 4 is driven by a gear transmission, not specifically shown, and each of its flutes 3 contains two distancing elements 6, 6' having pairs of surfaces 7, 7' which face in the opposite directions (namely, toward the corresponding axial ends of the respective flutes 3) and constitute abutments or stops for the adjacent rod-shaped articles. During a portion of each revolution of the drum-shaped conveyor 4, each flute 3 contains and transports a centrally located rod-shaped article 9 which is a filter plug of double unit length and is disposed between the respective distancing elements 6, 6', as well as two coaxial plain cigarettes 8, 8' of unit length which flank the respective filter plug 9 and whose outer end portions extend outwardly beyond the respective ends of the corresponding flutes 3. As can be more readily seen in FIG. 2, the outermost portion of each of the distancing elements 6, 6' tapers in a direction away from the bottom portion or innermost portion **3*a* of the respective flute 3. This facilitates insertion of the articles 8, 8' and 9 into the corresponding sections of the flutes 3. These sections include a relatively short centrally located section 3A for the filter plug 9 of double unit length and two relatively long outer sections 3B 3B' for the respective plain cigarettes 8 and 8'**.

The means for feeding rod-shaped articles 8, 8' and 9 into successive flutes 3 of the conveyor 4 is not shown in the drawing. Such feeding means can be identical with the feeding means shown in FIG. 1 of the aforementioned patent to Wahle et al. wherein the conveyor 4 of the present invention can replace the assembly conveyor 3, the conveyors 2 serve to feed pairs of coaxial plain cigarettes of unit length into successive flutes of the assembly conveyor 3 at a first transfer station T1, and an accelerating conveyor 11 serves to insert filter plugs of double unit length into successive flutes of the assembly conveyor 3 at a second transfer station T2 in such a way that each filter plug of double unit length is disposed between the two cigarettes which are supplied by the conveyors 2.

Figure 2:
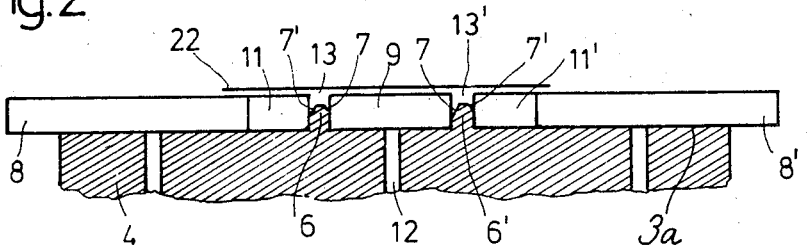
FIG. 2 is a fragmentary axial sectional view of a fluted conveyor forming part of a modified machine or a member of a different part of the machine shown in FIG. 1.

FIG. 2 shows on a larger scale that the group of coaxial rod-shaped articles 8, 8' and 9 carries an adhesive-coated uniting band 22 such as can be attached by the suction drum 19 to a group of coaxial rod-shaped articles on the transfer conveyor 12 in FIG. 1 of the aforementioned patent to Wahle et al. Thus, the conveyor 4 of the present invention can constitute the assembly conveyor or a transfer conveyor of a filter tipping machine. The uniting band 22 is thereupon convoluted around the filter plug 9 and around the adjacent end portions of the cigarettes 8, 8' to form therewith a filter cigarette of double unit length. The cigarettes 8 and 8' of FIG. 2 are already provided with filter plugs 11, 11' of unit length so that the cavities 13 and 13' are formed between the filter plug 9 on the one hand and the filter plugs 11, 11' on the other hand. In the next step, the filter cigarette of double unit length is severed midway across the convoluted uniting band 22 and midway across the filter plug 9 to yield two filter cigarettes of unit length each of which contains a plain cigarette 8 or 8', a first filter plug 11 or 11' of unit length, a second filter plug (half of the plug 9) of unit length and a cavity or chamber 13 or 13' between the two filter plugs of unit length. The cigarettes 8, 8' and the plugs 9 are held in their flutes 2 by suction (note the suction ports 12 which communicate with the flutes 3).

FIG. 1 further shows means for biasing the cigarettes 8 and 8' against the outer sides or surfaces 7' of the respective distancing elements 6 and 6'. Such biasing means comprises a pair of ring-shaped motion transmitting elements 14, 14' which are adjacent to the outer end portions of cigarettes 8, 8' in the flutes 3, coil springs 16 and 16' which connect the respective motion transmitting elements 14, 14' to ring-shaped flanges 17, 17' at the respective axial ends of the drum-shaped conveyor 4, ring-shaped flanges 18, 18' which connect the respective flanges 17, 17' to the conveyor 4, two levers 21, 21' which are adjacent to a predetermined portion of the endless path of movement of the flutes 3, and idler rollers 19, 19' at the free ends of the respective levers 21, 21'. The springs 16 and 16' tend to maintain the respective motion transmitting elements 14, 14' out of contact with the adjacent end portions of the cigarettes 8 and 8'. However, the distance between the idler rollers 19, 19' is such that the adjacent portions of the elements 14, 14' (which rotate with the conveyor 4) are moved toward each other and thereby push the cigarettes 8 and 8' toward the respective distancing elements 6, 6'. Thus, the distancing elements 6, 6' ensure that the width of each cavity (13, 13') is not less than the minimum acceptable value and the rollers 19, 19' ensure that the width of each cavity does not exceed the maximum acceptable value. The axial length of the plugs 9 is such that they can fit exactly between the surfaces 7 of the respective pairs of distancing elements 6 and 6'. Successive increments of the motion transmitting elements 14 and 14' move away from each other (as considered in the axial direction of the conveyor 4) as soon as they advance beyond that portion of the path for the flutes 3 where the elements 14, 14' are respectively acted upon by the rollers 19, 19'.

The rollers 19, 19' are disposed at least slightly ahead of the station where the groups of articles 8, 9, 8' are transferred from their flutes into the flutes of the next-following conveyor, such as the transfer conveyor 12 in FIG. 1 of the aforementioned patent to Wahle et al. The conveyors which feed the articles 8, 8' and 9 into successive flutes 3 are disposed ahead of the idler rollers 19, 19', as considered in the direction of rotation of the conveyor 4.

Each uniting band 22 can be provided with holes in the region of the cavities 13 and 13' to ensure the admission of requisite quantities of fresh atmospheric air when the smoker draws a column of smoke through the composite filter including a portion of the plug 9 and a plug 11 or 11' or through a simple filter merely including a portion of the plug 9. Alternatively, such holes can be formed subsequent to draping of uniting bands 22 around the respective groups of rod-shaped articles.

In the illustrated embodiment, the distancing elements 6 and 6' constitute integral parts of the conveyor 4. However, it is equally possible to produce the distancing elements as discrete parts which are thereupon bonded or otherwise permanently connected or adjustably secured to the conveyor 3 or to an analogous conveyor.

An important advantage of the improved machine is that the width of the cavities 13, 13' cannot be reduced below a minimum acceptable value and that the maximum width of such cavities can be determined by the simple expedient of mechanically or otherwise (e.g., pneumatically) shifting the outer rod-shaped articles (8, 8') toward the respective surfaces (7') of the distancing elements 6, 6'. Another important advantage of the improved machine is that the tapering free end portions of the distancing elements 6 and 6' do not interfere with the introduction of rod-shaped articles into their flutes and that the making or the application of such distancing elements involves a minimum of expenditures. Moreover, the shifting of outer rod-shaped articles toward the adjacent distancing elements can be carried out while the articles advance in a manner which is customary in filter tipping or other machines, and the shifting of articles in their flutes does not entail any increase in the space requirements of the machine.

The number of distancing elements in each flute can be increased to three or more or reduced to one. For example, if each flute contains a single distancing element, such element can serve as a means for preventing a reduction of the width of the gap between two coaxial filter plugs below a minimum acceptable value.

The flanges 17, 17' are adjustable in the axial direction of the flanges 18, 18'. This enables the machine to assemble filter plugs 9 with shorter or longer plain cigarettes.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a machine for manipulating rod-shaped articles of the tobacco processing industry, particularly for making filter cigarettes with cavities between the rod-shaped components thereof, the combination of a conveyor having elongated article-receiving flutes and at least one distancing element in each of said flutes, each of said distancing elements having a predetermined thickness, as considered in the longitudinal direction of the respective flute; and means for feeding discrete rod-shaped articles into said flutes at the opposite sides of the respective distancing elements so that the discrete articles at the opposite sides of the distancing elements are separated from one another by gaps having a width at least matching the thickness of the respective distancing elements.

2. The combination of claim 1, wherein said conveyor includes a rotary drum having a peripheral surface and said flutes are provided in the peripheral surface of said drum.

3. The combination of claim 1, wherein each of said distancing elements has a pair of surfaces facing away from each other toward opposite ends of the corresponding flute and constituting abutments for the articles at the opposite sides of such distancing elements.

4. The combination of claim 1, wherein each of said flutes has a bottom portion and at least a portion of each of said distancing elements tapers in a direction away from the bottom portion of the respective flute.

5. The combination of claim 1, wherein each of said flutes accommodates a plurality of distancing elements.

6. The combination of claim 5, wherein each of said flutes accommodates two spaced-apart distancing elements.

7. The combination of claim 1, wherein said distancing elements are integral with said conveyor.

8. The combination of claim 1, wherein said conveyor is arranged to advance said flutes along a predetermined path extending at right angles to the longitudinal directions of said flutes, and further comprising means for urging at least one article in each of said flutes toward the respective distancing element during advancement of said flutes along a predetermined portion of said path.

9. The combination of claim 8, wherein a portion of the one article in each of said flutes extends axially beyond the respective flute and said biasing means is arranged to act upon such portion of the one article in the respective flute during travel of the flute along said portion of said path.

10. The combination of claim 8, further comprising means for attracting the articles to said conveyor, at least during travel of the respective flutes along said portion of said path.

11. The combination of claim 1, wherein each of said flutes contains two spaced-apart distancing elements and the distancing elements in each of said flutes subdivide the respective flute into a relatively short centrally located section disposed between the respective distancing elements and two relatively long outer sections flanking said centrally located section.

* * * * *